US007534955B2

(12) United States Patent
Adams

(10) Patent No.: US 7,534,955 B2
(45) Date of Patent: May 19, 2009

(54) DEVICE AND METHOD FOR ADJUSTING THE TENSION OF A STRING OF A STRINGED INSTRUMENT

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 0 days.

(21) Appl. No.: 11/908,573

(22) PCT Filed: Mar. 17, 2005

(86) PCT No.: PCT/EP2005/002850

§ 371 (c)(1),
(2), (4) Date: Mar. 14, 2008

(87) PCT Pub. No.: WO2006/097124

PCT Pub. Date: Sep. 21, 2006

(65) Prior Publication Data

US 2008/0190273 A1 Aug. 14, 2008

(51) Int. Cl.

| | |
|---|---|
| ***G10H 3/18*** | (2006.01) |
| ***G10D 3/14*** | (2006.01) |
| ***G10D 1/08*** | (2006.01) |
| ***G10D 3/04*** | (2006.01) |

(52) U.S. Cl. ..... 84/731; 84/312 R

(58) Field of Classification Search ..... 84/312 R, 84/730, 731

See application file for complete search history.

(56) References Cited

U.S. PATENT DOCUMENTS

| | | | |
|---|---|---|---|
| 3,130,626 | A | 4/1964 | Martin |
| 3,813,983 | A | 6/1974 | Paul |
| 4,018,124 | A | 4/1977 | Rosado |
| 4,088,052 | A | 5/1978 | Hedrick |
| 4,128,033 | A | 12/1978 | Petillo |
| 4,197,779 | A | 4/1980 | Holman |
| 4,318,327 | A | 3/1982 | Toups |
| 4,426,907 | A | 1/1984 | Scholz |
| 4,681,010 | A | 7/1987 | Wilkinson |
| 4,791,849 | A | 12/1988 | Kelley |
| 4,803,908 | A | 2/1989 | Skinn et al. |
| 4,909,126 | A | 3/1990 | Skinn et al. |
| 5,065,660 | A | 11/1991 | De Buda |
| 5,265,513 | A | 11/1993 | Smith |
| 5,337,644 | A | 8/1994 | Fishman et al. |
| 5,343,793 | A | 9/1994 | Pattie |
| 5,390,579 | A | 2/1995 | Burgon |
| 5,767,429 | A | 6/1998 | Milano et al. |
| 5,986,190 | A | 11/1999 | Wolff et al. |
| 6,184,450 | B1 | 2/2001 | LeBlanc |

(Continued)

FOREIGN PATENT DOCUMENTS

| | | |
|---|---|---|
| AT | 006 906 U1 | 5/2004 |

(Continued)

*Primary Examiner*—Jeffrey Donels
(74) *Attorney, Agent, or Firm*—Hunton & Williams LLP

(57) ABSTRACT

The present invention describes a simple and effective method and a device for adjusting the tension of the string of a string instrument in which a holding section that is displaceable in or on the mounting block in relation to the latter and on which the first end of the string is attached is displaced by action of a hydraulic medium which is under a preselectable pressure for tightening or relaxing the string.

8 Claims, 5 Drawing Sheets

U.S. PATENT DOCUMENTS

| | | | | |
|---|---|---|---|---|
| 6,184,452 | B1 | 2/2001 | Long et al. | |
| 6,271,456 | B1 | 8/2001 | Nelson | |
| 6,278,047 | B1 | 8/2001 | Cumberland | |
| 2002/0104428 | A1 | 8/2002 | Wilson | |
| 2004/0231488 | A1* | 11/2004 | Hontsch | 84/313 |
| 2005/0217455 | A1* | 10/2005 | Ricci | 84/302 |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner

DEVICE AND METHOD FOR ADJUSTING THE TENSION OF A STRING OF A STRINGED INSTRUMENT

CROSS-REFERENCE TO RELATED APPLICATION

This application is a national stage of and claims the benefit of priority of International Patent Application No. PCT/EP2005/002850, filed on Mar. 17, 2005, which is relied on and incorporated herein by reference.

BACKGROUND OF THE INVENTION

The present invention relates to a method and a device for adjusting the tension on a string on a string instrument, said string being secured at a first end to a mounting block and at a second end to another mount.

For correct tuning of string instruments, it is necessary to accurately adjust the tension of the strings which are stretched between two mounting points on these instruments, so that when the string is struck, a standing wave of the correct frequency develops and thus the desired note is generated.

To this end, the string on a string instrument is usually rigidly secured at one of its two ends while the second end of the string is wound onto a spindle or a similar element and can be tightened or relaxed by winding or unwinding it, to thereby obtain the proper tuning of the string.

In particular, however, when the string instrument is also to be automatically tunable, i.e., by means of a controller which triggers a drive for changing the string tension on the basis of an actual note detected from a string that has been struck in comparing same with an ideal note, such known possibilities for adjusting the string tension are not always suitable. For example, in the case of a guitar, especially an electric guitar or an electric bass, the so-called tuning mechanisms or the pegs for tightening or relaxing the strings, are arranged on the so-called head of the instrument and thus on a comparatively small portion thereof. Although there are basic possibilities for mounting a motor drive for adjusting the string tension here, it is very difficult or almost impossible to arrange the entire controller for a system for automatic tuning of a guitar or an electric bass on this part of the instrument. To this extent, it is desirable to seek alternative options for adjusting the tension on the string of a string instrument.

BRIEF SUMMARY OF THE INVENTION

Such an alternative is provided with regard to a method for adjusting the tension on a string of a string instrument that is secured at a first end in a mounting block and at a second end on another mount, whereby a holding section that is displaceable in and/or on the mounting block in relation to the latter, the first end of the string being attached to said holding section, is displaced by the action of a hydraulic medium, which is under a preselectable pressure for tightening or relaxing the string. With regard to a device, a device implementing this goal is characterized by a holding section which is displaceably arranged in and/or on the mounting block in relation thereto and which can be displaced by action of a hydraulic medium which is under a preselectable pressure for tightening or relaxing the string. An advantageous embodiment of the device is characterized in that it has at least one bore in the mounting block with a bore section having an enlarged diameter and a bushing that is displaceable in at least one bore and is arranged so it seals off the hydraulic medium, whereby the bushing has a head with an enlarged outside diameter which corresponds essentially to the diameter of the bore in the section of the bore having the enlarged diameter and a protrusion having an outside diameter that corresponds essentially to the diameter of the remaining bore, whereby a shoulder is provided between the head and the protrusion of the bushing, whereby the head of the bushing is arranged in the bore section having an enlarged diameter and the protrusion of the bushing protrudes into the remaining bore so that a sealed annular space is formed between the shoulder between the head and the protrusion of the bushing and the transition from the bore section with the enlarged diameter to the remaining bore, and whereby at least one line for supplying and remaining hydraulic medium opens into this annular space.

Another advantageous embodiment of the device is characterized in that a bore section that has an enlarged diameter in comparison with the bore in the remaining section of the bushing is arranged in the head of the bushing.

A further embodiment of the device is characterized in that the bushing is a bushing made out of a piezoelectric ceramic material, and the bushing is electrically contacted to pick up signals obtained by piezoelectric means.

Finally, another embodiment of the device has a sensor for detecting an acoustic signal of the vibrating string, a converter for converting the acoustic signal into a digital signal for determining a respective frequency, a comparative unit for comparing the frequency thereby determined with a predetermined frequency, a device for adjusting the tension on at least one string and a controller for controlling the device for the adjusting the tension on at least one string on the basis of a deviation found between the frequency thereby determined and the predetermined frequency, characterized in that the device for adjusting the tension of at least one string is a device.

According to the present invention, the particular characteristic of the novel method for adjusting the tension on a string of a string instrument and/or the inventive device consists of the fact that instead of using a mechanism for winding the string, it works with a hydraulic medium that is under pressure, e.g., a fluid. This hydraulic medium acts on a holding section to which a first end of the string is applied and displaces this holding section and thus the end of the string secured therein in a mounting block in such a way that the tension on the string changes.

Use of a hydraulic medium, preferably a fluid, in particular a hydraulic fluid, allows automatic adjustment of the string without using any servomotors. Instead, it is possible to work with a hydraulic fluid in a hydraulic reservoir, for example, to adjust the string tension precisely in a pressure-controlled manner. Such a procedure is especially suitable for use in a device for automatic tuning of a string instrument such as a guitar, whereby the supply and removal of hydraulic medium for increasing and reducing the string tension, respectively, are controlled by a controller, depending on the deviation of the frequency of the note actually generated by the string from a predetermined frequency of an ideal note.

The bushing to be used according to the present invention in conjunction with the bore into which it is inserted, yields an effect similar to that of a piston in a cylinder, so that it can easily be displaced in the bore in the block by the hydraulic medium and/or in relaxation via the string tension, thereby tightening or relaxing the string. This approach is especially suitable for guitars, in particular electric guitars, and electric basses, where the strings are secured in a mounting block on the body of the instrument, and in the case of electric guitars they are occasionally also secured in a tremolo system block. Such a block usually already has bores into which the strings are introduced at one end, usually with a deflection amounting to approximately 90°. Without any great expenditure, it is possible here to replace a traditional block with a block equipped with the inventive bushings and with bores that have been widened accordingly without causing any drastic change in the instrument. This easily creates the possibility of an "automatic" string adjustment without making any significant change in the instrument itself.

A further embodiment serves to facilitate the attachment of the string ends in the bushing. For example, in the case of guitars, especially electric guitars, and electric basses, the strings typically have thickened areas, so-called ball ends, on the ends that are attached to the body of the instrument. Then the strings can be secured at these ends in the enlarged section of the bore in the bushing.

If the bushing is made of a piezoelectric ceramic material, it may advantageously also be utilized as a sound pickup with which the vibrations of the string which is in contact with it there can be picked up and converted into electric signals due to the piezoelectric property of the ceramic. These electric signals may then be magnified directly and used as acoustic signals or they may function as control signals to control MIDI functions, for example. Finally, these signals may also be used to supply information about the frequency of the vibrating string actually detected to the device for automatic tuning of a string instrument, said information then serving to adjust the string to the ideal frequency and finally to calculate the required additional tension and/or relaxation of the string.

BRIEF DESCRIPTION OF THE DRAWINGS

Additional features and advantages of the invention are derived from the exemplary embodiment which is described below on the basis of the accompanying figures. The present invention is described in the following description and is illustrated in the figures on the basis of an implementation of an electric guitar, whereby the invention is essentially not limited to this particular string instrument but instead may be applied in principle to all known string instruments. In the figures.

DETAILED DESCRIPTION OF THE INVENTION

Figure 1:
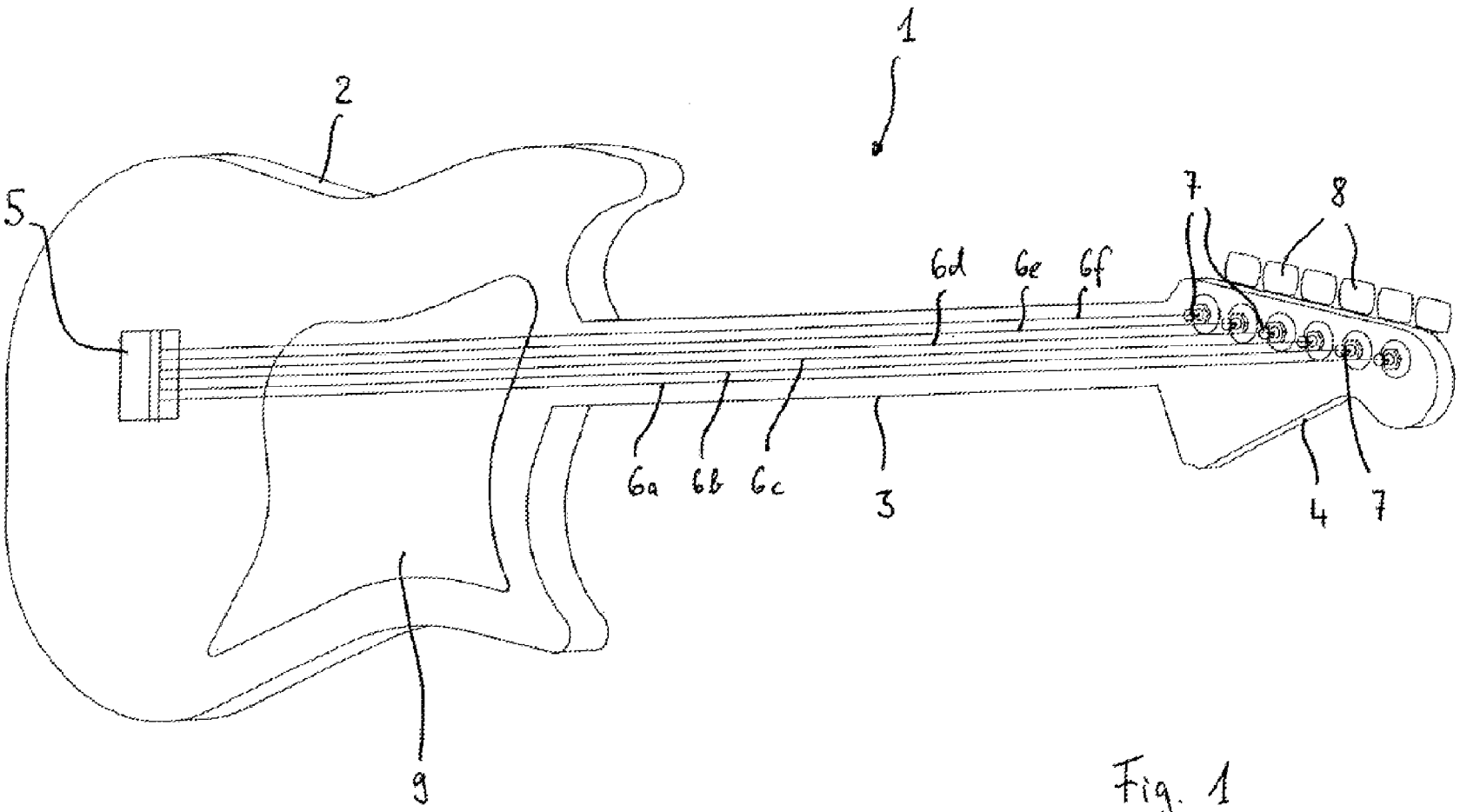
FIG. 1 shows schematically a view of an electric guitar as an example of a string instrument with a device according to this invention.

The figures show an embodiment of an inventive device on an electric guitar. The same elements are labeled with the same reference numerals.

Figure 2:
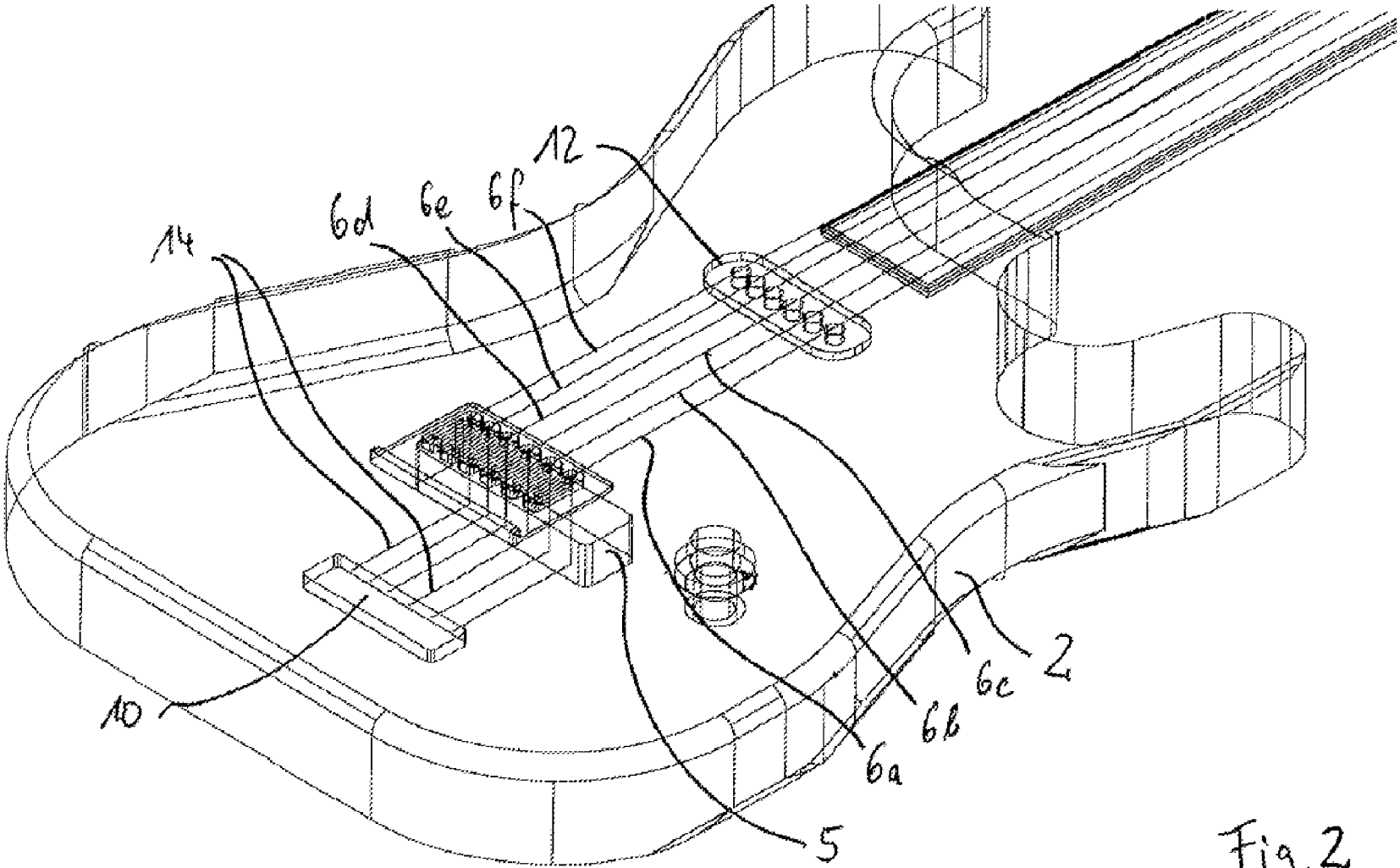
FIG. 2 shows an enlarged schematic diagram of the body of the electric guitar from FIG. 1, FIGS. 3*a-d* show various views of a tremolo system block equipped according to this invention as part of the guitar illustrated in FIG. 1 and FIG. 2.

First, FIGS. 1 and 2 show an electric guitar 1 in general. It can be roughly subdivided into a body 2, a neck 3 and a head 4. A tremolo system block 5 mounted as a mounting block on the body 2 of this electric guitar 1 embodies the present invention and therefore will be described in greater detail below.

The strings 6*a* through 6*f* extend from the tremolo system block 5 and are wound onto pegs 7 on the head 4, where the pegs 7 can be adjusted by thumbscrews 8. A pickguard 9 is arranged on the body 2 of the electric guitar 1 beneath the strings 6*a* through 6*f*.

FIG. 2 shows the body 2 of the electric guitar 1 on an enlarged scale. In addition, this also shows a control chip 10, which is to be explained in greater detail below, and a so-called [sound] pickup 12. Furthermore, this also shows lines 14 by which the control chip 10 is connected to the tremolo system block 5; this connection will be described in greater detail below.

Figure 3:
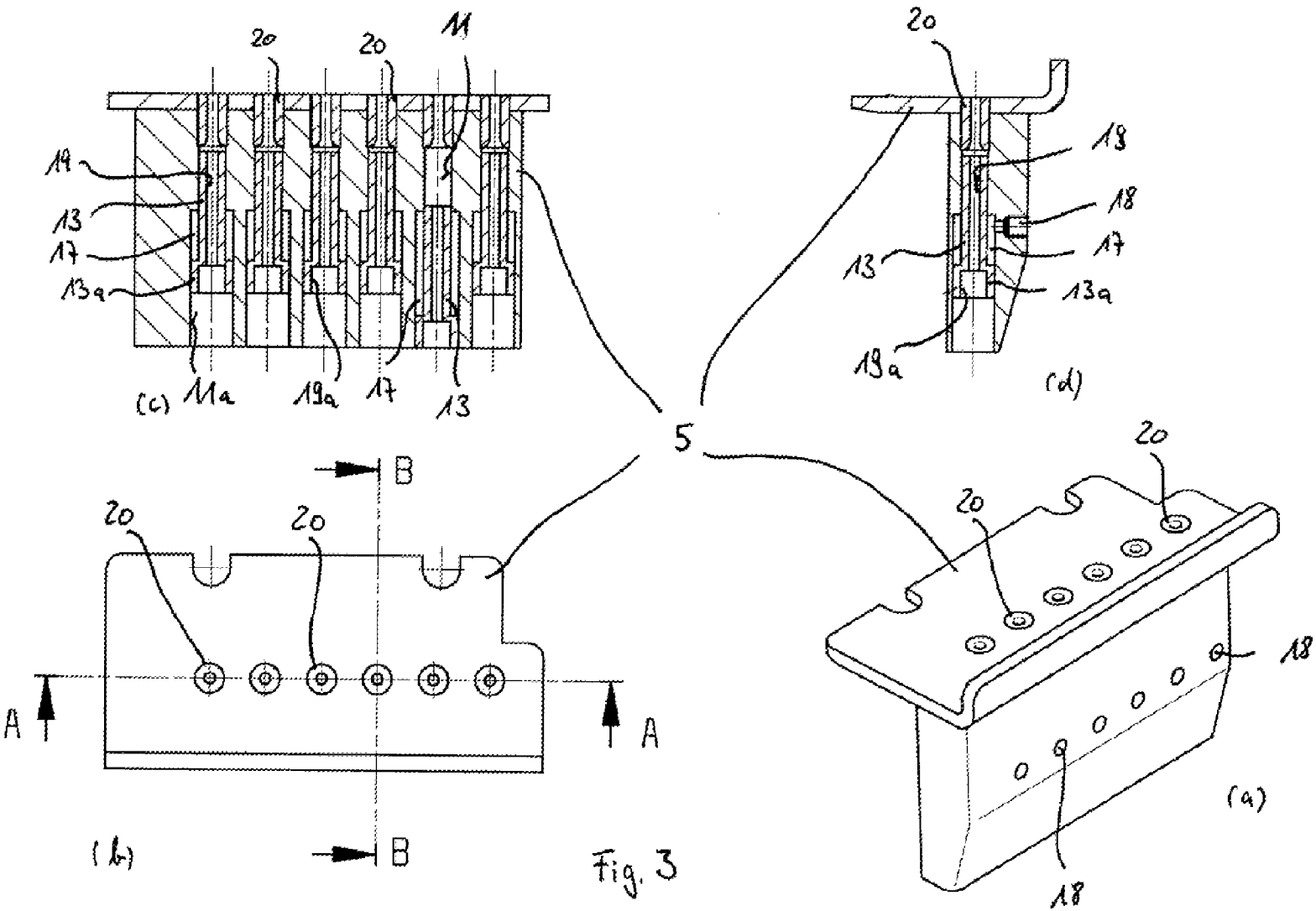

FIGS. 3*a* through *d* show the tremolo system block 5 in various views in greater detail. This tremolo system block 5 embodies the present invention. In FIG. 3*a* the tremolo system block 5 is shown in a three-dimensional view; in FIG. 3*b* it is shown in a view from above; in FIG. 3*c* it is shown in a sectional view along sectional line A-A from FIG. 3*b*; and in FIG. 3*d* it is shown in a sectional diagram along sectional line B-B from FIG. 3*d* [sic; 3*b*].

FIGS. 3*a* through 3*d* show that the tremolo system block 5 has a total of six bores 11 in which strings 6*a* through 6*f* can be secured by a method described in greater detail below. In a section at the bottom of FIG. 3*c*, the bores 11 have a section 11*a* with an enlarged diameter. Bushings 13 are arranged in the bores 11 so that they are longitudinally displaceable. Each bushing 13 has an enlarged head 13*a*. The outside diameter of the enlarged head 13*a* corresponds to the inside diameter of section 11*a* of the bore 11; the outside diameter of the remaining bushing 13 corresponds to the diameter of remaining bore 11. In this way, an annular space 17 is formed between the transition of the enlarged head 13*a* to the remaining bushing 13 and the section 11*a* of the bore 11 to the remaining bore 11. A feed line 18 in the form of a stub bore opens into this annular space 17. Through this feed line 18 a hydraulic medium can be introduced into the annular space 17; in the preferred exemplary embodiment, this hydraulic medium is a hydraulic fluid.

Figure 4:
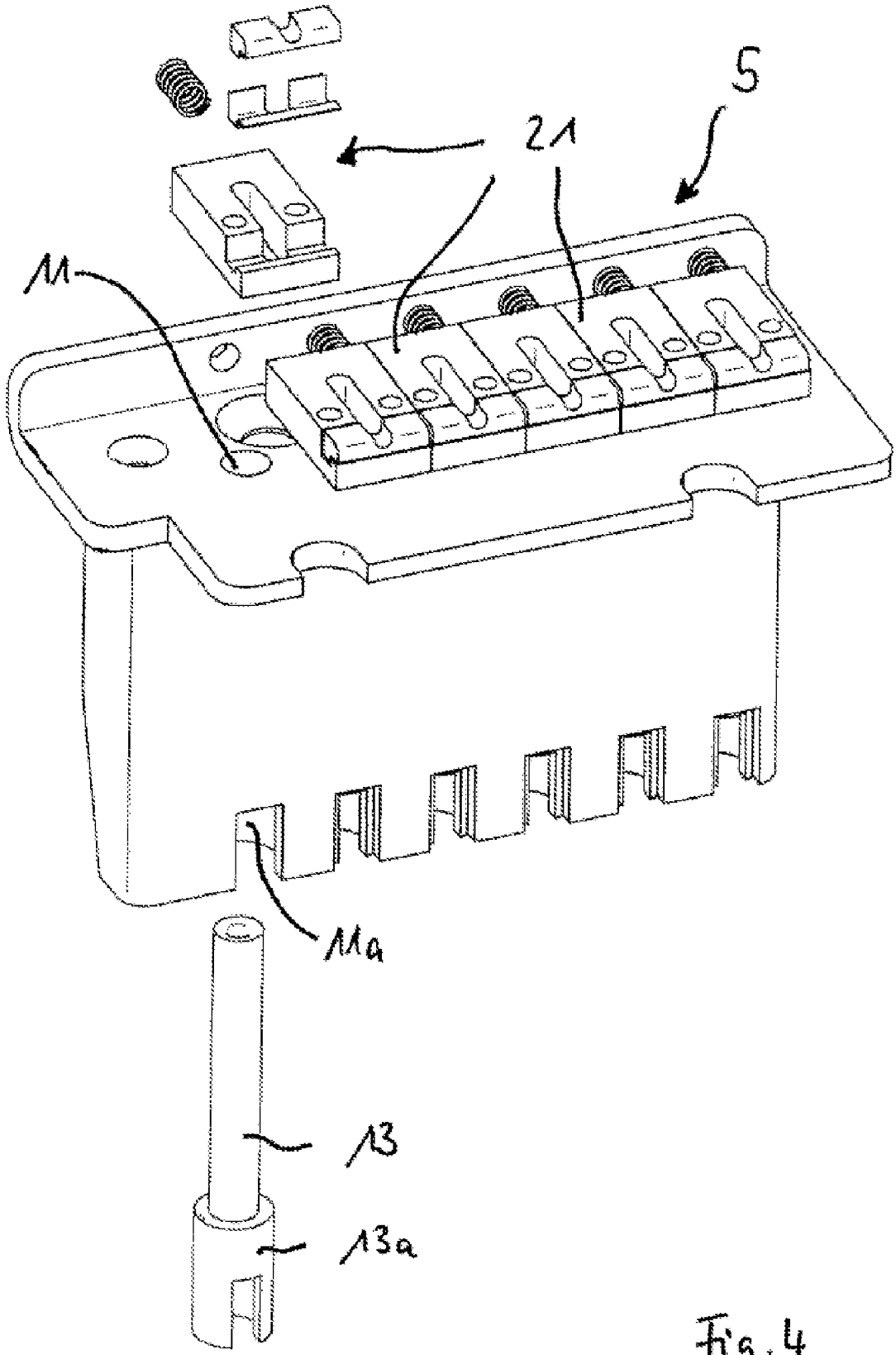
FIG. 4 shows a tremolo system block as shown in FIG. 3 with attached sliders, one of the sliders being shown in an exploded diagram.

An inner bore 19 provided in the bushing 13 has an enlarged inside diameter (section 19*a*) in the area of the enlarged head 13*a* of the bushing 13. Additional bushings 20 (which are not relevant for the present invention but are used for other reasons) can also be seen, these bushings sitting tightly in the bores 11 on the section of the tremolo system block 5 shown at the top of FIG. 3*c*. These bushings serve to insulate the strings which pass through the bushings 13 from the metal material of the tremolo system block 5. This insulation is necessary in certain applications, in particular when the strings 6*a* through 6*f* are to be used as electric conductors. When in use, strings 6*a* through 6*f* are secured at one end (the so-called ball end) in the enlarged section 19*a* of the bore in the bushing 13. The strings are then passed further through the bore 19 in the respective bushing 13 and then through the additional stationary bushing 20 and out of the tremolo system block 5 where they are guided over sliders 21, which are shown in FIG. 4 and from there over the neck 3 to the head 4 of the electric guitar 1, where they are wound onto the pegs 7. The bushings 13 and the bores 11 in the tremolo system block 5 are held in their position by hydraulic fluid in the annular space 17. The pressure of the hydraulic fluid exerted on the bushing 13 is in equilibrium with the force exerted by the string and/or its tension. If the string is to be tightened, then additional hydraulic fluid is introduced into the annular space 17 through the feed line 18 to increase the pressure. This causes the bushing 13 to move downward in the bore 11 in the alignment illustrated in FIG. 3*c* and therefore the string is put under tension. In the converse case, if the string is to be relaxed, hydraulic fluid is drained out of the feed line 18, so the bushing 13 is moved upward in the bore 11 in the orientation shown in FIG. 3*c*.

Hydraulic fluid from a hydraulic fluid storage element is preferred, this hydraulic fluid storage element can readily be arranged in the body 2 of the guitar 1 in particular without altering the geometry and/or the material of the guitar and therefore without milling or other material recesses. This requires only a corresponding valve switching, which is correctly triggered for tightening or relaxing the guitar strings in each case.

As an alternative to the operation of the device described here, it may also include a unit (dual-chamber system) that can be acted upon with hydraulic fluid in both directions, i.e., for tightening as well as relaxing the strings.

In the exemplary embodiment depicted here, it is important that the total length of the bushing 13 is longer than the length of the enlarged section 11*a* of the bore 11 so that here the annular space 17 is sealed with respect to the remaining bore 11 even in the condition of maximum string tension, and no hydraulic fluid can escape in an uncontrolled manner from the annular space 17.

In a preferred application, this system for adjusting the tension on the strings is integrated into a device for automatic tuning of the guitar. To do so, the control chip 10 shown in FIG. 2 is used. In this chip, an ideal value for the frequency of a basic vibration of each spring is stored. This control chip 10 is connected to sound pickups 12, for example, via signal lines to be able to detect the current frequency of the basic vibration of the strings. From the difference between the ideal value and the actual value, the control chip 10 calculates a measure by which the respective string is to be tightened or relaxed and controls the valve for the feeder line 18 assigned to this string accordingly, so that the respective adjustment of the string tension of the respective string can be performed by supplying or draining off the hydraulic fluid.

Instead of using the sound pickups 12 (electromagnetic pickups), piezoelectric elements introduced separately into the tremolo system block 5 or the bushings 13 themselves if they are made of a piezoelectric ceramic material may be used as the element for detecting the actual values of the frequency of the string.

Figure 5:
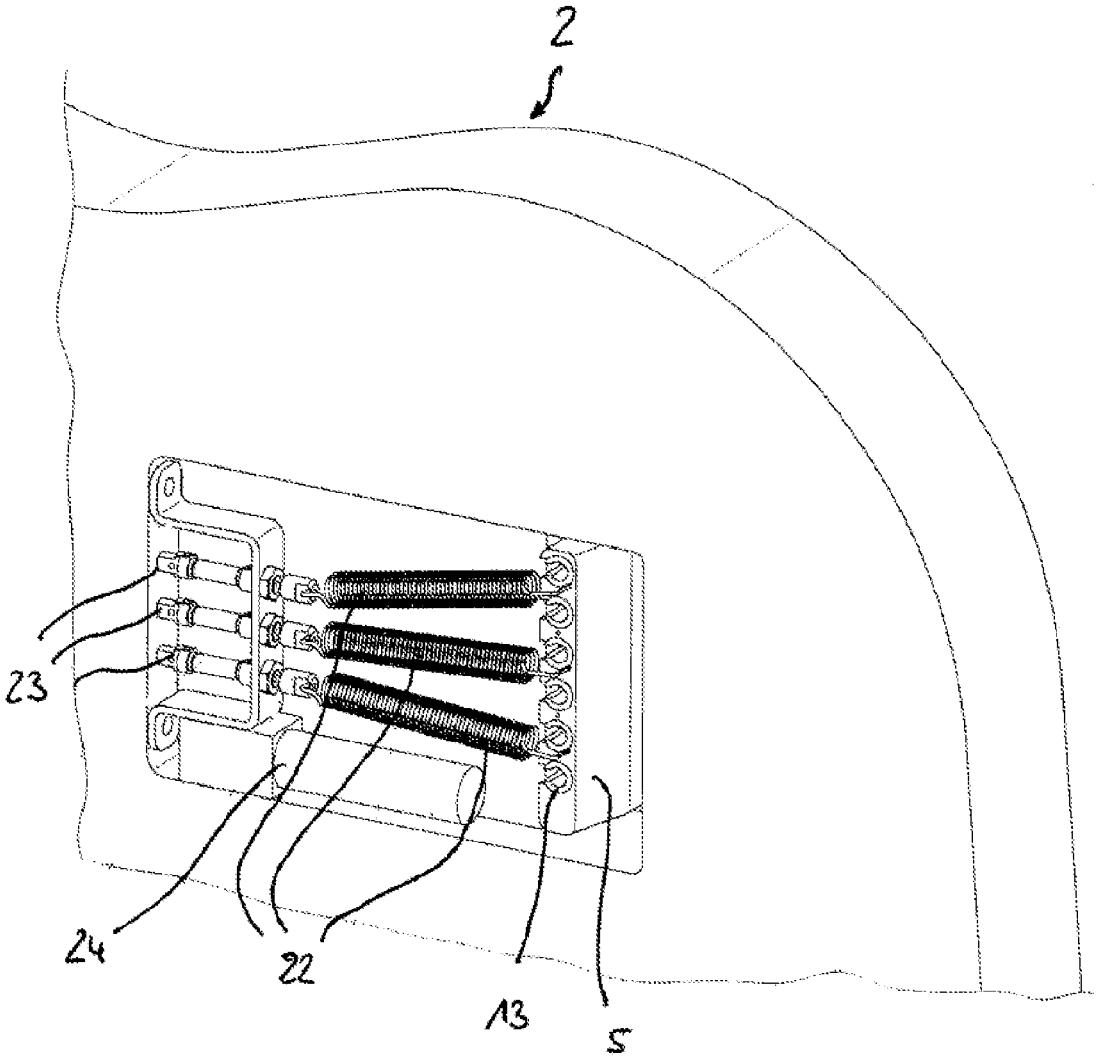
FIG. 5 shows a detail of a guitar body with the tremolo system block attached and held by tension springs.

Finally, FIG. 5 shows a detail from the body 2 of the electric guitar 1 as seen from the rear and/or from the bottom. The suspension of the tremolo system block 5 here which is equipped with the bushings 13 that operate according to the present invention can be seen in this figure. The tremolo system block 5 is held in balance with the help of three springs 22 which can be adjusted in their tension acting on the tremolo system block 5 by means of corresponding adjusting devices 23. This yields another possible use of the hydraulic adjustment. As part of a technical development that can be utilized independently of the present invention, it is conceivable for the spring tension of the individual springs holding the tremolo system block 5 in balance to be varied by means of hydraulic or pneumatic cylinders or in some other way activated by using hydraulic medium. In this way, an adjustment of the balance of the tremolo system block could be performed "automatically," e.g., to achieve different effects of playing the guitar or to adapt the tensile forces when using different tremolo systems, e.g., a Floyd Rose tremolo system. Such a cylinder is labeled here as 24. For example, it is also possible to replace the springs 22 as a whole by pneumatic cylinders and/or hydraulic cylinders. The latter approach can also be implemented independently of the invention claimed here and constitutes a separate invention by itself.

| List of Reference Numerals | |
|---|---|
| 1 | electric guitar |
| 2 | body |
| 3 | neck |
| 4 | head |
| 5 | tremolo system block |
| 6a-f | string |
| 7 | peg |
| 8 | thumbscrew |
| 9 | pickguard |
| 10 | control chip |
| 11 | bore |
| 11a | enlarged section |
| 12 | sound pickup |
| 13 | bushing |
| 13a | enlarged head |
| 14 | line |
| 17 | annular space |
| 18 | feed line |
| 19 | bore |
| 19a | section |
| 20 | bushing |
| 21 | slider |
| 22 | spring |
| 23 | adjusting device |
| 24 | pneumatic cylinder or hydraulic cylinder |

The invention claimed is:

1. A method for adjusting the tension of a string of a string instrument comprising introducing a hydraulic medium into a fluid space communicating with a holding section of a mounting block, wherein said holding section is coupled to a first end of a string and a second end of the string is coupled to another mount;

applying a preselectable pressure to the holding section directly with the hydraulic medium; and displacing the holding section of the mounting block with the hydraulic medium to tighten the string.

2. The method according to claim 1 further comprising removing hydraulic medium from the fluid space and displacing the holding section to relax the string.

3. The method according to claim 2 further comprising detecting an initial frequency of vibration of the string;

automatically adjusting the hydraulic medium in the fluid space with a control chip to apply a string tension with a predetermined frequency of vibration; and displacing the holding section with the hydraulic medium to adjust the string to the string tension with the predetermined frequency of vibration.

4. A device for adjusting the tension of a string of a string instrument comprising a mounting block including a holding section coupled to a first end of a string;

a fluid space including a hydraulic medium which is under a preselectable pressure and directly displacing the holding section to tension the string; and a hydraulic medium feed line communicating with the fluid space for supply and removal of the hydraulic medium.

5. A device according to claim 4, further comprising at least one bore in the mounting block that includes a bore section having an enlarged diameter;

a displaceable bushing in the at least one bore arranged to seal off the hydraulic medium, wherein the bushing includes a head with an enlarged outside diameter that corresponds approximately to the diameter of a bore section having an enlarged diameter and a protrusion having an outside diameter that corresponds approximately to a diameter of a remaining bore section; and a shoulder between the head and the protrusion of the bushing, wherein the arrangement of the head and protrusion of the bushing in the bore forms a sealed fluid space between the shoulder and a transition from the bore section with the enlarged diameter to the remaining bore section.

6. A device according to claim 5, wherein the bushing includes a first bushing bore section in the head of the bushing having a greater diameter than a second bushing bore section outside of the head.

7. A device according to claim 5, wherein the bushing comprises a piezoelectric ceramic material and the bushing is electrically contacted to pick up signals obtained by piezoelectric means.

8. The device of claim 4 further comprising a sensor for detecting an acoustic signal of the string during vibration;

a converter for converting the acoustic signal into a digital signal for determining a respective frequency;

a comparative unit for comparing the frequency thereby determined with a predetermined frequency; and a controller for adjusting the hydraulic medium and the tension on the string based on a deviation found between the frequency thereby determined and the predetermined frequency.

* * * * *